US006003192A

United States Patent [19]

Ciminise et al.

[11] Patent Number: 6,003,192

[45] Date of Patent: Dec. 21, 1999

[54] RADIUS SURFACE TROWEL

[76] Inventors: Salvatore J. Ciminise, 9599 W. Charleston, Apt. 2153, Las Vegas, Nev. 89117; LuAnn M. Jurishica, 1851 N. Green Valley Pkwy. #2221, Henderson, Nev. 89014

[21] Appl. No.: 09/005,168

[22] Filed: Jan. 9, 1998

Related U.S. Application Data

[60] Provisional application No. 60/035,358, Jan. 9, 1997.

[51] Int. Cl.[6] ..... B05C 17/10

[52] U.S. Cl. ..... 15/235.5; 15/235.8

[58] Field of Search ..... 15/235.3, 235.4, 15/235.5, 235.7, 235.8, 236.01, 236.07, 245.1; 425/458; D8/10

[56] References Cited

U.S. PATENT DOCUMENTS

| | | | |
|---|---|---|---|
| 1,564,172 | 12/1925 | Busch . | |
| 2,181,209 | 11/1939 | Seeman et al. . | |
| 2,947,017 | 8/1960 | Dybdahl . | |
| 3,123,947 | 3/1964 | Rawley . | |
| 3,341,878 | 9/1967 | Hubbard | 15/235.4 |
| 4,496,500 | 1/1985 | Haber | 425/458 |
| 4,631,019 | 12/1986 | House . | |
| 4,669,970 | 6/1987 | Perry . | |
| 5,125,459 | 6/1992 | Richards | 15/235.4 |
| 5,440,776 | 8/1995 | Kartler . | |
| 5,611,102 | 3/1997 | Lesinsky et al. | 15/235.5 |

*Primary Examiner*—Terrence R. Till
*Attorney, Agent, or Firm*—Kenehan, Lambertsen & Stein; John C. Lambertsen

[57] ABSTRACT

A hand tool consisting of a flexible blade with a working edge is provided for use with a cementitious material to permit the forming and finishing of columns and other curved surfaces of relatively large radii. A pair of gripping surfaces are formed in the flexible blade, consisting of handles to which handgrips have been attached. To enhance the ability of the user to control the curvature of the working edge, the handgrips are attached to the handles in a manner such that a portion of the handgrip overlies and is supported by the outer, lateral portion of the handle. Such an arrangement permits the user to apply force through the handgrips directly to the outer periphery of the flexible blade.

13 Claims, 4 Drawing Sheets

Fig. 1
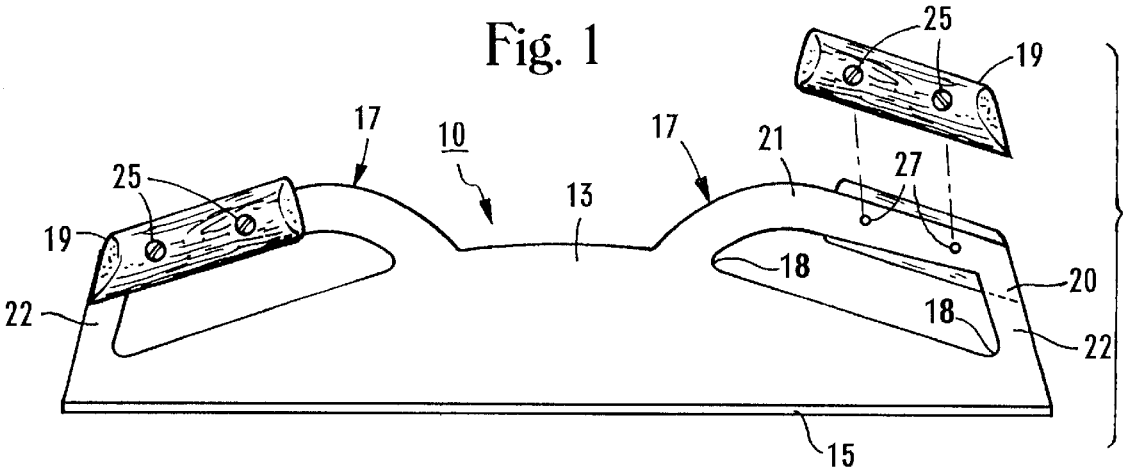
Fig. 2
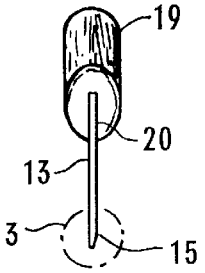
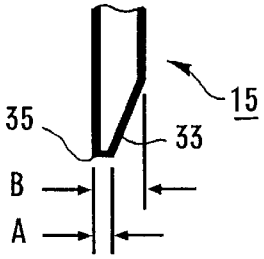
Fig. 3
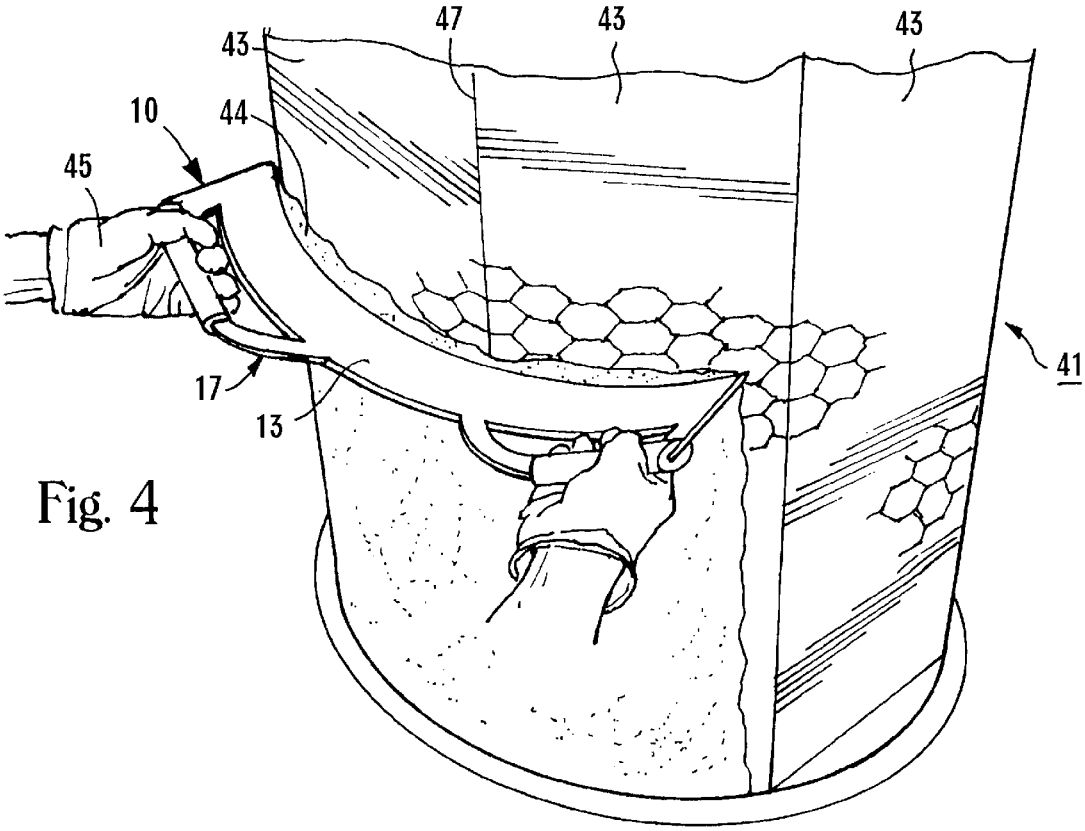
Fig. 4

RADIUS SURFACE TROWEL

CROSS-REFERENCE TO RELATED APPLICATION

This application claims the benefit of U.S. Provisional Application, Ser. No. 60/035,358, filed Jan. 9, 1997.

BACKGROUND OF THE INVENTION

1. Field of the Invention

The present invention relates to hand-held tools and, more particularly, to such tools as are useful for the application and shaping of moldable materials. More specifically, the present invention relates to a hand tool for finishing inside and outside rounded wall surfaces, contours, and columns with a cementitious material to provide a uniformly rounded surface configuration.

2. Description of the Prior Art

Plaster walls have been traditionally constructed by a labor-intensive process. A common wall requires the application of three individual plaster layers, each of which must be leveled and set prior to the application of the succeeding layer. Although considerable skill is required to achieve a flat, smooth surface over a large area, the end result is a wall having an unmistakable look and feel, along with superior sound insulation properties.

The use of such skilled labor runs counter to the present trends in the commercial and home construction industry. Emphasis today is on speed, efficiency, and cost-effectiveness towards the completion and profitability of construction projects. Competitive bidding pressures have made it increasingly difficult to rely on anything other than unskilled labor when bidding a construction project.

Except for the most expensive of custom installations, gypsum wall board, also know as "dry wall" has completely replaced plaster in the construction of walls and ceilings in modern homes and offices. Composed of a core of calcined gypsum, starch, water, and foam slurry sandwiched between special paper faces, gypsum board or dry wall retains the fire-resistant characteristics of gypsum plaster but can be installed with much less labor, and by less skilled workers. In addition, the use of dry wall brings very little "water" into a building, and thereby eliminates some of the waiting required with the curing and drying of gypsum plaster.

After the core material has hardened and bonded to the paper faces, the dry wall is cut to length, heated to drive off any residual moisture, and then bundled for shipping. For the majority of commercial and home construction applications the dry wall is cut into rectangular sheets of four (4) feet by eight-to-twelve (8–12) feet, and is one-half inch to five-eighths inch in thickness. Installation of the dry wall can occur over either steel or wood studs using self-tapping screws for metal studs and either screws or nails to fasten the dry wall to the wood support. After installation of the dry wall is complete, all of the joints between the boards and the indentations left by the nailing or screw attachments must be filled and smoothed before the surface of the dry wall is ready for final texturing or finishing.

The majority of dry wall panels used in finished wall constructions have a tapered edge to assist in forming a flush, invisible seam between adjacent panels when the joint finishing operation is completed. Finishing begins by the troweling of a layer of joint compound or plaster into the tapered edge joint formed along adjacent edges of adjoining dry wall panels. A paper or glass fiber reinforcing tape is then placed over the joint and covered with an additional layer of the joint compound. These first layers are allowed to dry and one or two finishing coats of the joint compound are then applied and sanded. A properly finished joint forms a wall that appears to be made of a solid sheet rather than discreet panels.

Flat gypsum board also can be used to form curved surfaces. When the curves are gentle, dry wall can conform to a large radius by simply bending the panels around a curving line of support studs. For somewhat sharper curves, the paper faces of the wall board can be moistened, which decreases the stiffness of the board prior to conforming it to the shapes required upon its installation. Drying causes the dry wall to again stiffen, permitting its attachment to the underlying support structure(s).

In custom and semi-custom residential construction, there has been a recent trend towards providing such visual features as rounded walls, recesses, columns, and bay window areas. In commercial buildings, the trend has been toward providing one or more "walls as art" located in the "common" areas. In each of these construction applications there are framing irregularities, creases, and/or gaps that are created when attaching the flat, dry wall materials to the supportive radius wall framing.

The majority of these features require radii that are very difficult to achieve by simply deforming the flat dry wall panels. Instead, the present practice is to cut the dry wall into multiple sections that are then pieced together to create a substantially curved surface. A smoothed, finished surface is then obtained by the application of either the joint compound or a plaster material to cover the joint irregularities. The multi-piece surface is thereby formed into a visually-continuous surface, having multiple-curved surfaces expressed therein.

However, achieving such a uniformly radiused finish has proven to be extraordinarily difficult for the dry wall laborers to achieve. In addition to requiring a higher level of skill on the part of the workman, it has proven necessary to devise specialized tools to assist the dry wall installers in obtaining the desired surface uniformity, such as the corner finishing tool of Kartler, U.S. Pat. No. 5,440,776. As noted in Perry, U.S. Pat. No. 4,669,970, workmen have frequently resorted to reshaping their trowels to approximate the working edges to the desired surface radius. Other workmen have attempted to maintain the required curvature by utilizing a bent piece of cardboard.

Neither of these solutions have proven to be particularly desirable. The modified trowel must be held at a specific angle relative to the dry wall surface throughout the finishing process. This includes maintaining the angle along the entire length of a specific, curved wall feature. Also, to maintain continuity from one curvature to another, this same angle must be carefully repeated. With respect to the use of cardboard, such improvised tools are not capable of uniformly maintaining an appropriate curvature or hand hold. Consequently, it has proven to be extraordinarily difficult to maintain a fixed angular position between the improvised tool and the work surface.

Ideally, it would be desirable to provide a plastering tool that is sufficiently adaptable as to be able to form curved surfaces at multiple locations, and not require specialized tools for each of various types of curved surfaces.

SUMMARY OF THE INVENTION

It is an object of the present invention to provide a hand tool for applying cementitious materials, and one that is adaptable to easily conform to a variety of curved surfaces.

In this regard, a flexible blade having a working edge formed thereon is provided with a pair of gripping surfaces. By the careful manipulation of such gripping surfaces, a user is able to carefully and accurately control the flexure of the working edge when applying and/or shaping the cementitious material to form a curved surface.

The flexible blade permits the working edge formed thereon to conform to a variety of curved surfaces. A pair of handles are formed in the flexible blade, with hand grips preferably attached to each handle. Such hand grips enhance the ability of the user to accurately control the shape of the working edge. Such control is required to both conform the working edge to the curvature required to be created or emulated, as well as to maintain such a curvature over time as the working edge moves across the work surface.

In use, after the cementitious compound is applied to the planar supporting surface, such as a section of dry wall, the user flexes the central blade, curving the working edge in a manner that substantially approximates the desired curvature of the finished surface. The hand tool is then brought into contact with the cementitious compound, and is moved across the support surface. The excess cementitious compound is squeezed out ahead of the moving working edge, to be distributed over the support surface, taking the form of the flexed working edge. This permits the user to shape the cementitious material and create the desired rounded and curved surfaces overlying the planar or multifaceted support surfaces.

Some further objects and advantages of the present invention shall become apparent from the ensuing description and as illustrated in the accompanying drawings.

BRIEF DESCRIPTION OF THE DRAWINGS

FIG. 1 is a partially exploded front elevation view of a radius surface trowel in accordance with the present invention;

FIG. 2 is a side elevation view showing a radius surface trowel in accordance with the present invention;

FIG. 3 is an enlarged side elevation view taken within circle 3 of FIG. 2, showing an edge of the radius surface trowel in accordance with the present invention;

FIG. 4 is a partial perspective view showing a manner in which a radius surface trowel of the present invention is used to apply plaster or a joint compound to a column that has been framed out of multiple sections of dry wall;

DETAILED DESCRIPTION OF THE PREFERRED EMBODIMENTS

Figure 5:
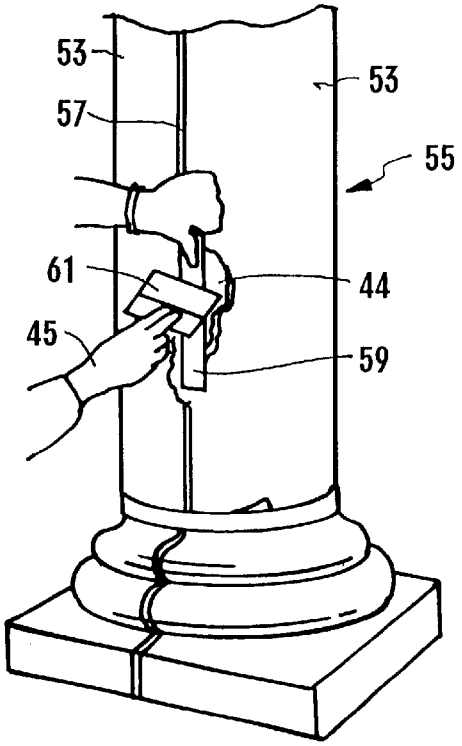
FIGS. 5–7 are partial perspective views, similar to that of FIG. 4, showing a further manner in which a radius surface trowel of the present invention is used to apply plaster or a joint compound to a connecting joint formed when a column is fabricated out of two circular sections.

Reference is now made to the drawings wherein like numerals refer to like parts throughout. In FIG. 1 a radius surface trowel 10 consists of a central blade 13 that terminates in a lateral working edge 15. A pair of handles 17 are formed in the central blade 13 at a location opposite that of the working edge 15. In FIG. 1 the handles 17 are formed in a manner that creates a pair of acutely-angled corners. To prevent premature flexure cracks from forming in the central blade 13 adjacent to such corners, it is preferred that such corners terminate in a radius 18.

In a preferred embodiment, a hand grip 19 is attached to each of the handles 17 to provide an enhanced supportive and gripping surface for use when manipulating the radius surface trowel 10. As is depicted in FIG. 1, the hand grip 19 is preferably fabricated out of wood, or a product having similar qualities, and is attached to the handle 17 after first being received upon the handles 17, within a central slot 20 formed in the hand grip 19 (see FIG. 2). Alternatively, the hand grip 19 could be formed out of two separate pieces (not shown).

In either case, the positioning of the hand grip 19 relative to the handles 17 is important. Each of the handles consist of a grip 21 and a lateral extension 22. As is depicted in FIG. 1, a lower portion 23 of the hand grip 19 extends below the grip 21 and rests against the lateral extension 22. As so placed, the user is able to apply force directly to the lateral extension 22, which greatly assists in causing the flexure of the outer portions of the working edge 15.

Once received upon the handles 17, the hand grip 19 is attached to the handles 17 by a pair of fasteners 25 that pass laterally through the hand grip 19 and a corresponding pair of fastener apertures 27 formed in each of the handles 17. When the hand grip is formed out of wood, the fasteners 25 are preferably wood screws. The central blade 13 is preferably formed out of a high density polyethylene.

As is depicted in FIG. 2, the central blade 13 terminates in a narrow, working edge 15. As is best shown in FIG. 3, the working edge 15 consists of a beveled edge 33 that terminates in a tip 35 having a width A. To maintain the proper flex of the working edge 15, the width A of the tip 35 is preferably approximately forty percent of the overall width B of the central blade 13. Additionally, although a single bevel is shown in the Figures, it is to be understood that the tip 35 may also consist of a double bevel structure, or an embedded, metal blade.

A first manner in which the radius surface trowel 10 can be used will now be described in the context of FIG. 4. A column 41 is depicted as having been constructed out of a plurality of individual planar members 43. Where a circular column is desired, it is necessary to transform the individual faces into what appears as a rounded surface through the application of either plaster or a joint compound (both are referred to as "mud"). A sufficient quantity of mud is applied to the adjoining flat surfaces to permit the dry wall installer to shape the mud compound into a continuous curvilinear surface.

After applying the mud compound to the mid-portion of the planar areas requiring the greatest "buildup", a dry wall installer 45 grasps the radius surface trowel 10 by the handle 17 and then flexes the central blade 13 to curve the working edge 15 in a manner that substantially approximates the desired curvature of the finished column 41. The curved mudtool 10 is then brought into contact with the mud compound 44 and, using a firm pressure, the radius surface trowel 10 is moved along the surface of the column 41, parallel to the direction in which the curvilinear surface extends. The radius surface trowel 10 distributes the excess mud compound 44 along the length of the column, building up areas to create a curved outer surface that exhibits a uniform continuity throughout the vertical extent of the column.

In certain surface constructions, preformed curved or semi-circular members are used to form all or part of a contoured surface. In FIG. 5, a pair of semi-circular, preformed panels 53 are attached together to form a decorative column 55. A pair of seams 57 (only one shown in FIG. 5) is formed where the pair of preformed panels 53 join. To complete the construction of the decorative column 55 requires filling each of the seams 57 with the mud compound. If properly done, the mud fills the seams 57 and blends with the adjacent surface of the preformed panels 53 to create a "seamless," curved surface.

As is shown in FIG. 5, covering the seam 57 begins by first placing a strip of joint tape 59 over and along the seam 57, using a thin layer of the mud compound 44. The dry wall installer 45 then presses against the installed joint tape 59 using a small blade 61, which removes the excess mud compound 44 from under the joint tape 59.

Figure 6:
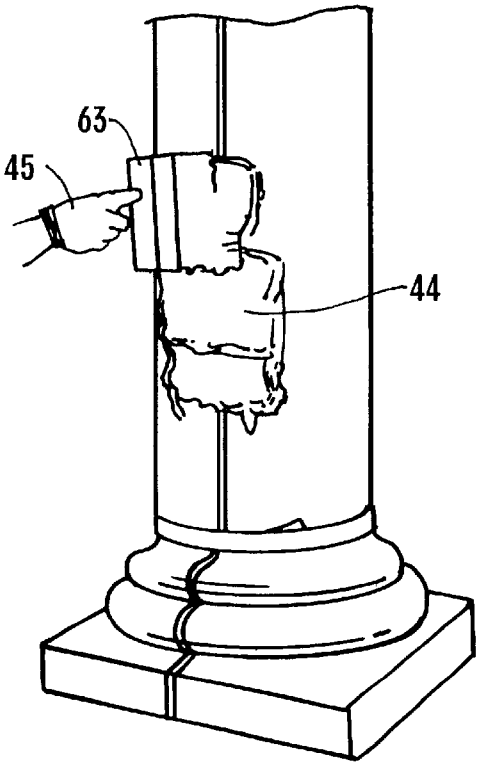

As is shown in FIG. 6, the dry wall installer 45 then more liberally applies the mud compound 44 over the joint tape 59 and extending over the adjoining portions of the semi-circular preformed panels 53 using a dry wall knife 63. This excess dry wall compound 44 is thereby available to be used to "build up" the area over the seam 57 and form the finished, continuously curved surface.

Figure 7:
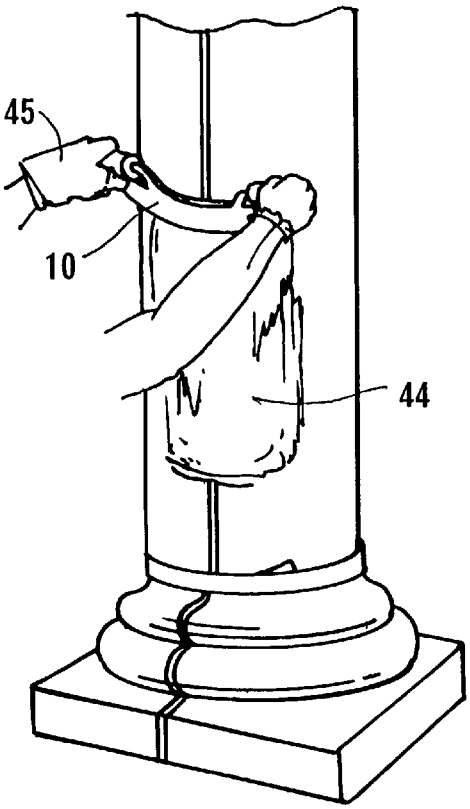

After application of the excess mud compound 44, FIG. 7 illustrates the manner of use by which the radius surface trowel 10 creates the finished, curved surface. The dry wall installer 45 places the radius surface trowel 10 firmly against the area of the column 55 adjacent the seam 57. While applying a constant, inward pressure against the surface of the decorative column 55, the radius surface trowel 10 is moved along the seam 57.

The pressure exerted by the radius surface trowel 10 causes the excess mud compound 44 to "float out" in front of the beveled edge 33. This excess mud compound 44 is available for use in filling any low spots along the seam area as the working edge 15 moves along the decorative column 55. As a result, the working edge 15 of the radius surface trowel 10 is able to form a smooth and continuously curved surface over the seam 57.

Figure 8:
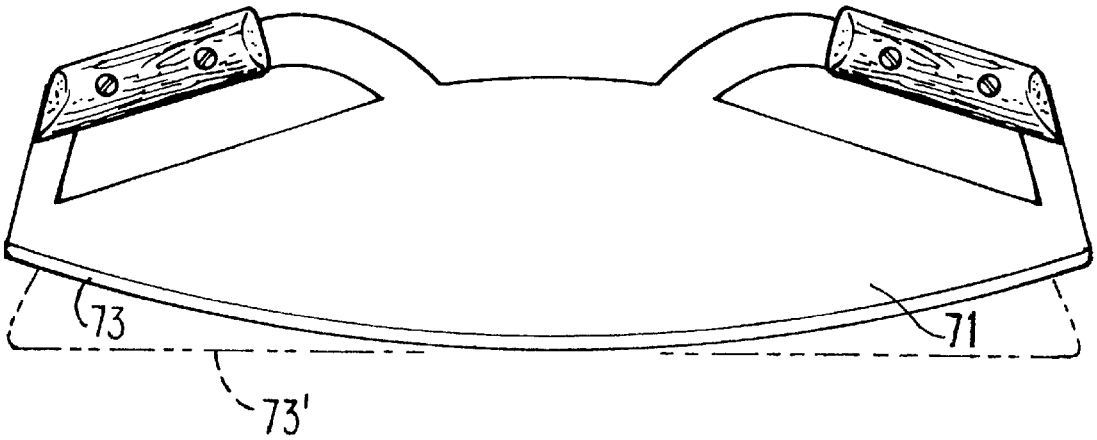
FIG. 8 is a front elevation view similar to that of FIG. 1, with portions in phantom, showing an alternate design of a radius surface trowel in accordance with the present invention.

Under certain circumstances it is desirable to utilize a convex central blade 71, as is shown in FIG. 8. As a result, a convex working edge 73 is formed (denoted as 73' when the convex central blade 71 is flexed), which is useful for finishing concave radial recesses, such as those used to receive decorative plants. For such structures, a concave radial surface intersects with a flat surface, such as a ceiling or a shelf. Larger concave areas would not require such convex modifications.

The radius surface trowel of the present invention is preferably fabricated out of a plastic material, and most preferably out of a one eighth inch thick section of high density polyethylene. While the overall dimensions of the radius surface trowel are dictated by the particular surface construction against which it will be used, as a general matter, a radius surface trowel having dimensions of twenty inches in length and five and a quarter inches in height has proven to be useful for a wide variety of specific surface applications.

Figure 9:
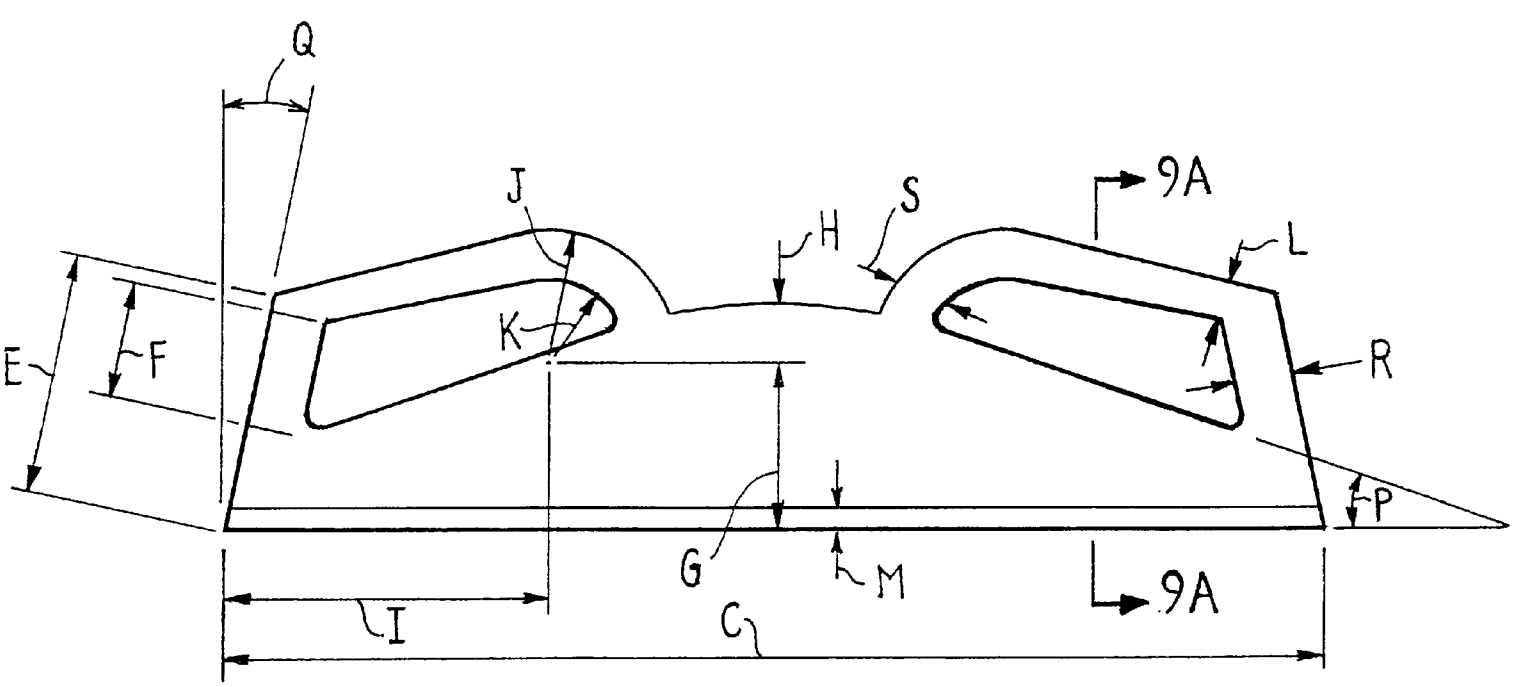
FIG. 9 is a dimensional schematic showing a radius surface trowel of the present invention; and FIG. A is an elevated cross-section taken along line 9A–9A of FIG. 9, showing certain lateral dimensions of a radius surface trowel in accordance with the present invention.
Figure 9A:
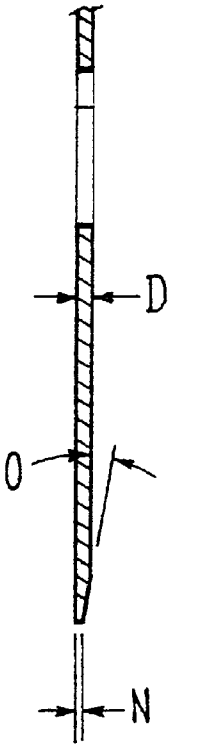

Surprisingly, the dimensions and the angular placement of the handles 17 has been found to be critical to the ease in bending control of the central blade 13. For such radius surface trowels of 20 inches in width and 5¼ inches in height, the presently preferred dimensions illustrated in FIGS. 9 and A are as shown in Table I, below.

TABLE I

| | | |
|---|---|---|
| C = 20 inches | D = ⅛ inch | E = 3¾ inches |
| F = 1½ inches | G = 2⅞ inches | H = 1 inch |
| I = 5⅞ inches | J = 2⅜ inches | K = 1 7/16 in. |
| L = ⅝ inch | M = ⅜ inch | N = ⅛ inch |
| O = 22 degrees | P = 18 degrees | Q = 12 degrees |
| R = 1 inch | S = ⅞ inch | |

For larger curved surfaces, such as columns of greater diameter, a radius surface trowel of greater width is desired. A presently-preferred size for such larger curved surfaces is 26" in width. Tools of greater width become increasingly difficult to control.

In addition to being useful for work on columns, the present radius surface trowel can be used to form a smooth, curved surface in a variety of other applications. By way of example and not limitation, the present tool can be used to smooth the plastic film used to provide window tinting to curved automobile windows, as well as in performing auto-body repair work where the fiberglass fill must be smoothed to match the curvature of the surrounding metal body. Additionally, the present invention can be used to shape many of the curved surfaces in sub-ground pools constructed using sprayed gunite.

My invention has been disclosed in terms of a preferred embodiment thereof, which provides a radius surface trowel that is of great novelty and utility. Various changes, modifications, uses, and alterations in the teachings of the present invention may be contemplated by those skilled in the art without departing from the intended spirit and scope thereof. It is intended that the present invention encompass such changes and modifications.

We claim:

1. A hand tool for forming and finishing curved surfaces of a structure with a cementitious material, said hand tool comprising:

a flexible blade having a working edge formed thereon;

a pair of spaced apart handles formed in said flexible blade at a pair of locations symmetrically located about a central axis of said flexible blade, each of said pair of handles having a grip and a lateral extension; and a handgrip attached to each of said pair of spaced apart handles at a location on each of the handles that overlies both the grip and at least a portion of the lateral extension, whereby the handgrips more efficiently and effectively transfer applications of force by a user to deform the working edge as required to form and/or finish a particular curved surface.

2. A hand tool according to claim 1, wherein said pair of spaced apart handles are formed on a longitudinal edge of said flexible blade opposite said working edge.

3. A hand tool according to claim 2, wherein each of said handgrips is a distinct and separate structure from the respective handles to which it is attached.

4. A hand tool according to claim 3, and further comprising a pair of fasteners received within each of said handgrips and fastening said handgrips to the respective handles.

5. A hand tool according to claim 2, wherein said working edge is a linear blade.

6. A hand tool according to claim 2, wherein said working edge is a convex blade.

7. A hand tool for forming and finishing columns and other relatively large radius curved surfaces of a structure with a cementitious material, comprising:

a pliable sheet having a longitudinally extending working edge formed therein;

a pair of handles formed in said pliable sheet and located along a longitudinal edge opposite said working edge, wherein each of said pair of handles is located adjacent a separate lateral edge of said pliable sheet, with a lateral extension formed between said handle and said lateral edge; and a pair of handgrips, each attached to a separate one of said pair of handles.

8. A hand tool as described in claim 7, wherein at least a portion of each of said handgrips is supported by a portion of said lateral edge.

9. A hand tool as described in claim 8, wherein said pair of handgrips are fabricated separately, apart from said pliable sheet.

10. A hand tool as described in claim 9, wherein said pair of handgrips are fabricated out of wood.

11. A hand tool as described in claim 9, and further comprising a plurality of fasteners, at least one of which is received within each of said pair of handgrips, attaching same to a respective one of said pair of handles.

12. A hand tool as described in claim 8, wherein said working edge is a linear blade.

13. A hand tool as described in claim 8, wherein said working edge is a convex blade.

* * * * *